US009691210B2

(12) United States Patent
Lorenz et al.

(10) Patent No.: US 9,691,210 B2
(45) Date of Patent: Jun. 27, 2017

(54) COIN PROCESSING DEVICE AND CORRESPONDING METHOD FOR CLASSIFYING COINS

(71) Applicant: NOVOMATIC AG, Gumpoldskirchen (AT)

(72) Inventors: Sven Lorenz, Gumpoldskirchen (AT); Michael Rudolf Luft, Gumpoldskirchen (AT)

(73) Assignee: NOVOMATIC AG, Gumpoldskirchen (AT)

( * ) Notice: Subject to any disclaimer, the term of this patent is extended or adjusted under 35 U.S.C. 154(b) by 0 days.

(21) Appl. No.: 15/103,753

(22) PCT Filed: Dec. 16, 2014

(86) PCT No.: PCT/EP2014/078077
§ 371 (c)(1),
(2) Date: Jun. 10, 2016

(87) PCT Pub. No.: WO2015/091561
PCT Pub. Date: Jun. 25, 2015

(65) Prior Publication Data

US 2016/0314636 A1 Oct. 27, 2016

(30) Foreign Application Priority Data

Dec. 19, 2013 (DE) ..... 10 2013 114 569

(51) Int. Cl.
*G07D 5/02* (2006.01)
*G07D 7/121* (2016.01)
*G07D 5/10* (2006.01)

(52) U.S. Cl.
CPC ..... *G07D 5/02* (2013.01); *G07D 7/121* (2013.01); *G07D 5/10* (2013.01)

(58) Field of Classification Search
CPC ..... G07D 5/00; G07D 5/04; G07D 2205/00; G07D 7/12; G07D 7/121; G07F 9/00
(Continued)

(56) References Cited

U.S. PATENT DOCUMENTS 3,797,628 A 3/1974 Fougere et al.
RE29,090 E * 12/1976 Fougere ..... G07D 5/08 194/324

(Continued)

FOREIGN PATENT DOCUMENTS

CH 532296 A 12/1972
DE 102011055538 A1 5/2011

(Continued)

OTHER PUBLICATIONS

International Search Report dated Mar. 16, 2015 for International Application No. PCT/EP2014/078077, filed on Dec. 16, 2014, (3 pages).

*Primary Examiner* — Mark Beauchaine
(74) *Attorney, Agent, or Firm* — Avery N. Goldstein; Blue Filament Law PLLC

(57) ABSTRACT

A coin processing device (10) and a method for classifying coins are provided. The coin processing device (10) includes at least one computerized controller (9) having a storage unit (36), and at least one coin channel (34) for guiding a coin (35). The at least one coin channel (34) includes at least one sensor (37) suitable for measuring a passage time of the coin (35). An accelerating device (43) is connected to the computerized controller (9) and is designed to accelerate the coin (35) in a reproducible manner. A target speed value for a specified coin (35) is stored in the storage unit (36). An actual speed value is calculated based on the transport time detected by the sensor (37). A coin class of the coin (35) is ascertained by the computerized controller (9) from the (Continued)

comparison of the target speed value and the actual speed value.

11 Claims, 2 Drawing Sheets

(58) Field of Classification Search
USPC ..... 194/339, 342
See application file for complete search history.

(56) References Cited

U.S. PATENT DOCUMENTS

| | | | | | |
|---|---|---|---|---|---|
| 4,667,093 | A * | 5/1987 | MacDonald | ..... | G07D 5/02 194/326 |
| 6,520,308 | B1 * | 2/2003 | Martin | ..... | G07D 3/06 194/317 |
| 6,585,581 | B2 * | 7/2003 | Nottingham | ..... | G07D 3/04 453/3 |
| 2010/0093416 | A1 * | 4/2010 | Seelig | ..... | G07F 17/32 463/16 |

FOREIGN PATENT DOCUMENTS

| | | | | | |
|---|---|---|---|---|---|
| DE | 202011052023 | U1 | 1/2012 | | |
| EP | 1126420 | A2 | 8/2001 | | |
| EP | 2 107 533 | A2 * | 10/2009 | ..... | G07D 5/10 |
| EP | 2107533 | A2 | 10/2009 | | |
| WO | 8606246 | A2 | 11/1986 | | |

* cited by examiner

COIN PROCESSING DEVICE AND CORRESPONDING METHOD FOR CLASSIFYING COINS

TECHNICAL FIELD

The present invention refers to a coin processing device with a computer control, comprising a storage unit and at least one coin channel to guide a coin. Furthermore, the present invention refers to a process for classifying coins with such a coin processing device.

STATE OF THE ART

Coin processing devices are usually used as money-operated devices such as automatic goods-vending machines, ticket selling machines, entertainment machines, etc. Money, in particularly in form of coins, is inserted in the coin-insertion slot. Within the scope of this invention not only coins but also, for example chips, tokens, medals or other coin-like objects are considered as 'coin'. By means of the coin channel, the inserted coin is redirected to a cash register and/or a machine's coin payment unit—a so-called Hopper—in which coins are provided in a sorted manner. In case the device disburses a coin, it is usually done via the hopper at the side of the coin-disbursement channel, passed into a coin-disbursement basin.

Due to device-inherent problems or manipulations, it may be necessary that in addition or alternatively to a relative complex authenticity testing, a relative simple detection of a determined feature for a particular coin class should be carried out. Thus coins can be assessed and errors can be excluded or minimized.

The patent EP 1126420 A2 discloses a coin detecting device, from which a size of coin can be determined by means of inductive sensors. Here, a coin conveys through a coin race with inductive sensors, which are arranged along the coin race at different heights. From each of these sensors, a signal is sent to a control unit and a coin size or a diameter of each coin is determined by the control unit based on a ratio of the respective sensor signals. However, the process of the mechanism disclosed in patent EP 1126420 A2 has the disadvantage that the coin is conveyed due to the effect of gravity on the sensor—that is, the coin race is horizontally inclined so that the coin passes along the race. This may lead to different movements of coins of the same size and consequently to inaccurate measurements and errors in determining the size of a coin.

The patent DE 20 201 1 052 023 U1 comprises also a device for handling coins, in which coins are conveyed at a sensor unit by means of a conveyor unit along a transport level in a transport direction. With the help of this sensor unit, at least one dimension (for example, thickness, diameter, etc.) of coins inserted in the device are determined and classified or sorted. However, the device disclosed in patent DE 20 201 1 052 023 U1 has the disadvantage of a very complex and possibly susceptible-to-malfunction and high-maintenance construction. The conveyor unit comprises two endless belts, conveyed around two rollers, each having a fixed position of several pins mounted for the transport of the coins. Due to dust or dirt, for example, it can very easily lead to malfunction of the feed unit and thus to a failure of the device.

SUMMARY OF THE INVENTION

The invention is therefore based on the object to provide a coin processing device and an associated process for classifying coins with which a classification of a coin is ensured with high precision, in a simple manner and without consuming resources application or complex conveyor unit.

The object is achieved by a coin processing device as well as an associated process of the aforementioned type with features according to the independent claims. Advantageous embodiments of the said invention are described in the dependent claims.

The coin processing includes a computer control with a storage unit and at least one coin channel to convey the coin. In this case, the one coin channel, at least, has a suitable sensor for measuring a processing time of the coin that is connected to the computer control. The coin channel is further provided with a coin accelerating device to generate a reproducible acceleration for the coin, so that in each case the coin passes the sensor with a particular velocity, according to the coin class. By means of signals of the sensor, which are processed by the computer control, the time is determined in which the coin passes through the measurement section. In the computer control, particularly in the storage unit, there is a piece of information based on determination of the coin class. In this way, the disbursement of a coin can rule out a coin differing from the particularly coin class.

For example, the velocity and time a 5-cent coin requires to pass the sensor is highly differing from the time, for example a 20-cent coin requires. Accordingly, by means of the computer control, the data captured by the sensor can determine the coin class. If needed, for example, further testing of the coin (for example based on size, thickness, weight, embossing depth, material properties, etc.) can be carried out to clearly determine their value and/or authenticity. Certainly it is possible to equip the coin channel at the side of insertion or at the side of disbursement, or both coin channels can be equipped with a sensor. Furthermore, several coin channels can be provided, each of which is equipped with a sensor on the side of insertion. The coin can be conveyed through a coin channel lying on its end-face or peripheral surface by the coin that is sized and aligned accordingly. It is also irrelevant whether the coin is circumferentially angular or round.

Particularly in a horizontal alignment or a slightly horizontal inclined assembly of the coin channel, in which no sufficient velocity can be achieved for transporting the coin, the coin channel can advantageously be connected with the accelerating device. The accelerating device allows the possibility of transporting the coin against gravity, thus also in a horizontally rising coin channel.

The accelerating device is connected to the computer control and is designed for reproducible acceleration of the coin. By connecting the accelerating device with the computer control, it is possible to activate the acceleration, if necessary. In a reproducible acceleration the data captured by the sensor from coins of a class, ideally a relatively low disbursement and therefore are evaluated by the computer control with a comparatively low effort.

Furthermore, a target velocity value is stored for a particular coin in the storage unit, which is comparable to an actual velocity value. The target velocity value can be determined and stored, for example in a learning mode of the computer control. In this example, several coins of the same class are transported by the coin channel and the time to pass the measuring section is statistically analyzed and recorded. Of course, the tentatively determined deviations of the target velocity value can be accepted. From the processing time the coin needs for the measuring section, detected by the sensor, as well as the information of acceleration and/or dimensions of the coin and/or the energy used to accelerate the coin, the actual velocity or actual velocity value of the coin is calculated by means of the computer control. By comparing the stored target velocity value and the calculated actual velocity value, a coin class of each coin can easily be determined.

Preferably the sensor is designed as an optical, acoustic or magnetic measurement mechanism. An acoustic measuring mechanism can produce, for example, an ultrasonic field and generate sound reflections produced by the coin, which are transmitted to the computer control for evaluation. A magnetic measuring mechanism may preferably comprise at least one Hall-sensor. In this case, additional information regarding the magnetic properties of the coin are determined in the magnetic field of such a measuring mechanism, which can be used for a clearer determination of the coin class.

The sensor can also be constructed as optical measuring mechanism. Preferably, the optical measuring mechanism comprises at least one photoelectric barrier. A photoelectric barrier is typically an electro-optical system that registers an interruption of a light beam and, for example converts it into electrical signals. This allows moving objects—such as a moving coin in a coin channel—to be detected. Usually, photoelectric barriers have at least one light source as transmitter (for example light emitting diode, etc.) and a sensor unit as receiver (for example phototransistor, photodiode, etc.) for a radiation emitted by the transmitter. The photoelectric barrier can, for example have a type (for example through-beam photoelectric sensor, fork light barrier, reflective light barrier, light curtains, etc.), which reliably delivers a measured value when a coin enters the measurement range of the photoelectric barrier and when it exits that area. By means of the measured values, the computer control then can directly or indirectly determine the class of the detected coin.

In a preferred embodiment, the photoelectric barrier comprises one light source and two light receivers which are arranged in the flow direction of the coin on both sides of the light source to receive reflected light radiation at the peripheral edge of the coin. A light receiver receives a reflected light signal of the coin entering into the measuring section and the other light receiver at coin exiting from the measuring section. In a circular coin, for example the diameter of the coin can be determined through the angle of reflection.

Preferably, the accelerating device for the coin is designed mechanically, pneumatically or electromagnetically. For example, the mechanical accelerating device can comprise an external power-operated actuator, having a spring mechanism for the transport of the coin. The pneumatic accelerating device is, for example coupled with a compressor for producing compressed air or a compressed air reservoir. Further, the accelerating device may additionally or alternatively comprise, for example a traveling magnetic field or the like.

Advantageously, the computer control activates a visually and/or acoustically perceptible alarm mechanism in case of an impermissible deviation of the actual velocity value from the respective target velocity value. If a certain coin passes through the coin channel with the sensor, the computer control knows the target velocity of the coin. This target velocity is then compared with the actual velocity value of the coin passing the sensor. A deviation of the actual velocity value from the corresponding target velocity value outside a predetermined tolerance suggests an error or a manipulation of the coin processing device, whereby action by the service personnel is required. The alarm mechanism can be installed at any place, particularly on a central computer or in a control room. The connection of the computer controlling the coin processing device with the alarm mechanism can be wired or wireless—for example via a radio link such as Wi-Fi.

The coin channel, for example, combines a coin-disbursement unit of the coin processing device with a coin-disbursement basin. The sensor is therefore at the side of disbursement of the coin processing device. In this case, a relatively simple check of the coins that are disbursed according to their class is sufficient, since a verification of the inserted coins is carried out at the side of insertion, for example in a coin validator, and coins sorted according classes are provided in the coin-disbursement unit. The coin channel is suitably designed to convey the coins on the periphery. That is, the coin is conveyed on edge. To reduce frictional influences on the velocity of the coin in the coin channel, the coin channel has a friction minimizing surface or surface coating, at least in the area of the sensor. Furthermore, the coin may be connected to a coin-insertion slot on the insertion-side of the coin processing device. This configuration is advantageous if either no coin validator is provided or an additional test of the processed coins should be carried out.

Furthermore, the object is achieved by a process for classifying coins in the coin processing device, wherein the coin processing device comprises at least one computer control with a storage unit, one accelerating device, generating a reproducible acceleration of a coin and at least one sensor arranged in a coin channel for detecting a processing time of the coin. The coin is conveyed in the coin channel past the sensor by means of the accelerating device, the sensor measuring a processing time of the coin. The measured processing time is submitted to the computer control, which in turn determines an actual velocity value of the coin based on the measured processing time. The actual velocity value is then compared with a target velocity value by the computer control and determines a coin class of the coin. The target velocity value for a particular coin is stored in the storage unit. Thus, in a simple manner and with little effort, the class of coin of the coin to be classified and the disbursement of a coin other than the particular coin class are excluded. Furthermore, the values detected by the sensor and processing times by using the accelerating device with reproducible acceleration have a relative scattering and thus can be easily analyzed by computer control.

It is advantageous if the target velocity value for each coin or coin class is identified by tests in a learning mode of the computer control and then stored in the storage unit. In this example, several coins of the same coin class pass the coin channel at the sensor and determine the respective processing time, statistically analyzed and then stored. Alternatively, the target velocity value for each coin or coin class of the computer control may also, for example, be determined mathematically.

Ideally, each target velocity value can be assigned with permissible tolerances, which are stored in the storage unit with the respective target velocity value of the coin. If the actual velocity value of the coin is compared with the target velocity value of the coin, revealing a deviation outside a respective tolerance observed or exceeded the respective tolerance, a visually and/or acoustically perceptible alarm can be activated by the computer control. This can lead to simple and rapid alerts of errors or a manipulation of the coin processing device and the service personnel can intervene accordingly.

It also proves to be advantageous if the accelerating device is activated from the computer control by means of an incoming signal. Such a signal can, for example be generated or caused by coins to be disbursed and activate the accelerating device or the respective external power-operated actuator (for example air compressor, spring mechanism) to speed up the coin with the reproducible acceleration and convey the coin at the sensor in the coin channel.

It is understood that the aforementioned features and the ones explained below are useful, not only in the particular combination indicated but also in other combinations. The scope of the invention is defined only by the claims.

BRIEF DESCRIPTION OF FIGURES

The invention is explained below by several examples with reference to the accompanying figures.

The following shows.

IMPLEMENTATION OF INVENTION

Figure 1:
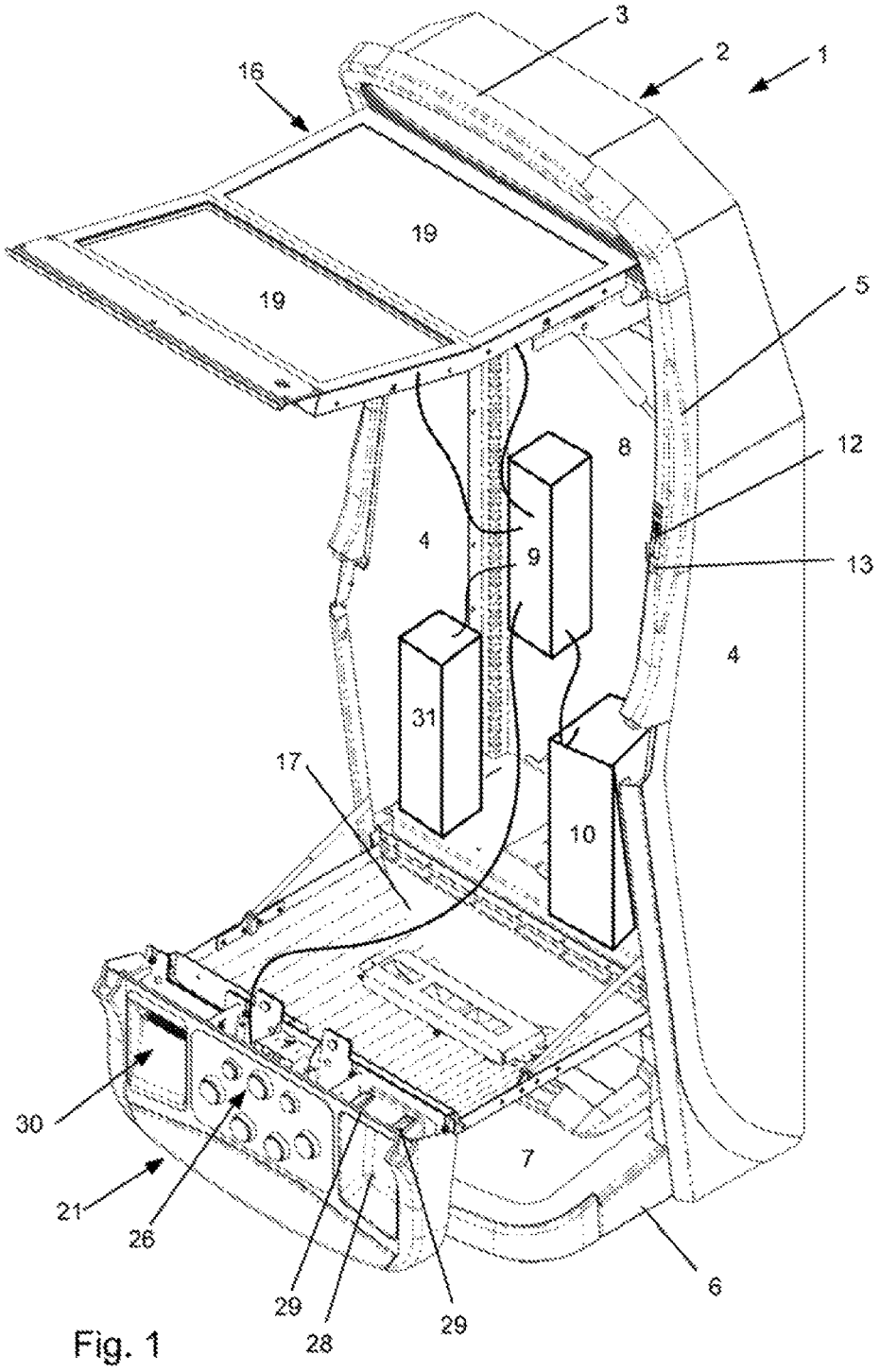
FIG. 1 a simplified perspective illustration of a console of a game apparatus for entertainment according to the invention, with the front door opened and a coin processing device according to the invention FIG. 2 an exemplary and schematic illustration of the coin processing device of FIG. 1

The game apparatus for entertainment by way of example and schematically illustrated in FIG. 1 comprises a console 1 having a top-side header 2 with a curved frame part 3. Furthermore, the game apparatus for entertainment has two opposite side walls 4 with frontally associated frame 5, a base 6 with a rear-illuminable cover plate 7 and a rear wall 8. The console 1 comprises a computer control 9, including a game sequence control, and is coupled to a coin processing device 10. As exemplified in FIG. 2, the coin processing device 10 comprises a coin validator 32, a coin box 11 and a coin-disbursement unit 33. The coin validator 32 is on top of the coin channel 34, behind the associated frame 5, connected to a coin insertion slot 12 installed in a frame 5. A return key 13 in the frame 5 is located beneath the coin insertion slot 12—such as illustrated in FIG. 1—for example to disburse money.

To close the console 1 from the front side, an upper front cap 16 and a lower front flap 17 are provided. Two screens 19 arranged above the other are mounted, for example in the upper front flap 17 to display game content. The game apparatus for entertainment can be operated via operating elements 26 in a closed state of the console 1—that is, when the two front flaps 16, 17 are folded—which are housed in a desk 21 and, for example are designed as a push-button switch. The operating elements 26 are coupled with the computer control 9 via connecting lines. Laterally, the control elements 26 comprise on one hand a coin-disbursement basin 28, which is in the closed state of the lower front flap 17 coupled to the coin processing device 10 via slots 29. On the other hand, a bill input/output basin 30 is housed next to the control elements 26 on the desk 21, which is connected with a bill processing unit 31 coupled with a console 1. The bill processing unit 31 comprises, for example a bill checkout and/or a dispenser and is connected to the computer control 9.

Figure 2:
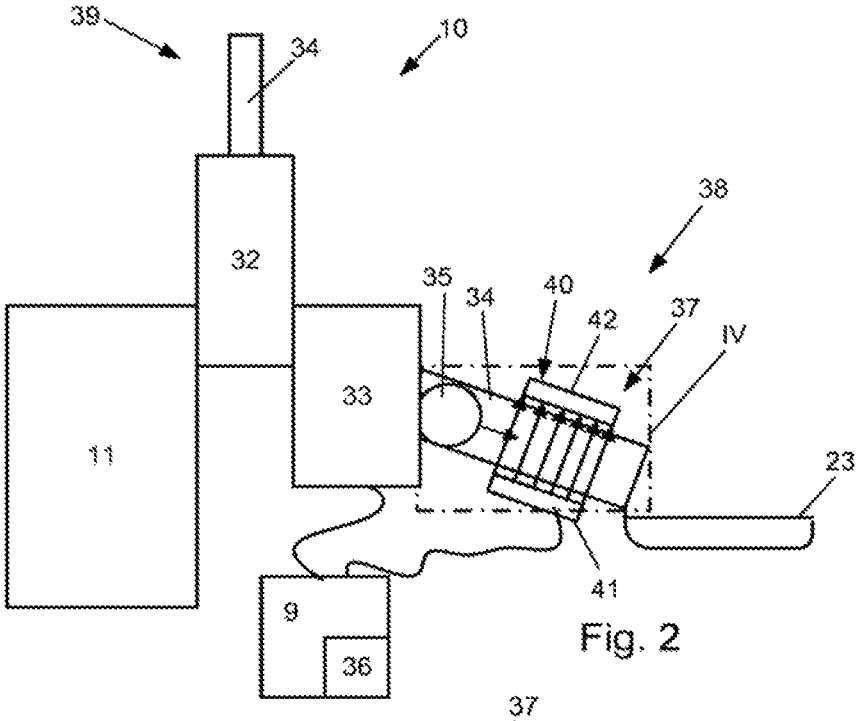

The coin validator 32 of the coin processing device 10 is coupled with the computer control 9 of the game apparatus of entertainment comprising the storage unit 36. Furthermore, the computer control 9 is coupled with the coin-disbursement unit 33 and with a coin channel 34 at the side of disbursement 38 of the coin processing device—as illustrated in FIG. 2. A coin 35 passes through the coin insertion slot 12 in the coin channel 34 of the coin processing device 10 and from there into the coin validator 32. Subsequently, the coin 35 is conveyed to the coin box 11 or in the coin-disbursement unit 33, in which the coins 35 are sorted in a classified manner. If now the disbursement of coins 35, for example, due to the operation of the return key 13 or due to an event of game processing effect should occur, they pass the coin channel 34 at the side of disbursement 38. This coin channel 34 has a sensor 37, which also is passed by the coins 35. As illustrated in FIG. 2, the sensor 37 may be formed as a photoelectric barrier 40, with the sensor 37, a measurement signal is sent to the computer control 9 when the coin 35 enters an area between the transmitter 41 and receiver 42. At the time of exiting this area, a measurement signal is sent to the computer control 9 as well.

In an alternative embodiment the sensor 37 may comprise two spaced fork photoelectric barriers. In case of interruption of the light beam, a signal is sent to the computer control 9 of each of the fork photoelectric barriers for further evaluation.

With the retention time of the coin 35 in the area of the photoelectric barrier 40 and due to known geometric data of coin classes and/or the length of the photoelectric barrier 40, an actual velocity value can be determined. This actual velocity value is compared with a target velocity value. Target velocity values for all disbursed coins 35 are determined—either by tests in a learning mode of the computer control or mathematically—evaluated and provided with tolerances stored in the storage unit 36. Thus, a conclusion of currently disbursed coin classes can be drawn. Since the computer control 9 has information regarding the disbursed coin class based on the determined velocity, it can determine whether the correct coin class or due to error or manipulation another one is currently disbursed, particularly in case of disbursement of a superior coin class. If there is an impermissible deviation between the detected actual velocity value of the coin 35 and the target velocity value, a visually and/or acoustically perceptible alarm, for example, can be activated by the computer control 9.

An acceleration of the coin 35 for passing the measuring area can, for example take place due to the horizontal downwardly inclined coin channel 34 due to gravity. Ideally, an accelerating device 43 is provided, which is coupled with the computer control 9 and through which a reproducible acceleration of the coin 35 and a sufficient velocity for transporting the coin 35 can be obtained (for example at a slightly inclined, horizontal, or rising coin channel 34). Such an accelerating device 43 for the coin 35 can, for example be designed pneumatically, mechanically or electromagnetically.

Figure 3:
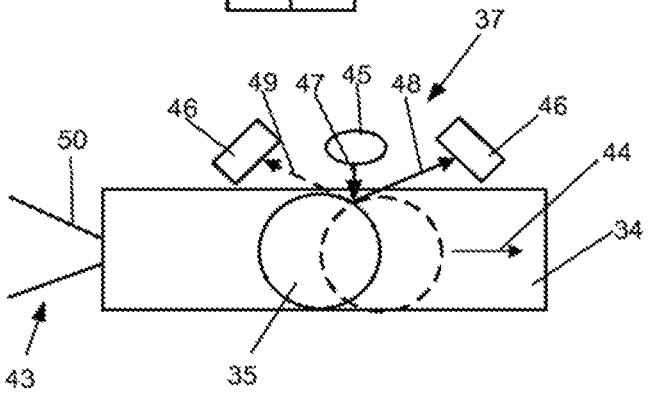
FIG. 3 a schematic and exemplary illustration of Detail IV of the coin processing device according to the invention, according to FIG. 2

As illustrated in FIG. 3, the coin channel 34 can be horizontally aligned at the side of disbursement 38 of the coin processing device 10. The coin channel 34 is attached to the accelerating device 43 which is, for example designed as an end-mounted compressed air nozzle 50. The signal applied on the computer control 9 of coin-disbursement 35, compressed air is directed at a specific flow rate to accelerate the coin 35 in the direction of arrow 44 into the coin channel 34. The coin channel 34 is equipped with the sensor 37, comprising a light source 45 and two mutually in a defined position as well as to the light source 45 angularly offset arranged light receiver 46. In case the coin 35 is now entering with its peripheral edge in the area of the emitted light beam, of the light source 45 according to arrow 47, a reflection of the light beam results according to arrow 48 to the one light receiver 46. From this light receiver 46 a corresponding measurement signal is sent to the computer control 9. Then, a scattering of the light beam occurs due to the curvature of the peripheral circumference of the coin 35, until a reflection occurs at the other light receiver 46 according to arrow 49. A corresponding measurement signal from this light receiver 46 is then also sent to the computer control 9. Based on the measurement signals in addition to the measurement of time, where the coin 35 needs to pass through the sensor 37, a calculation of the diameter of the coin 35 and the resulting velocity of the coin 35 is also possible. This ensures an improved classification.

Figure 4:
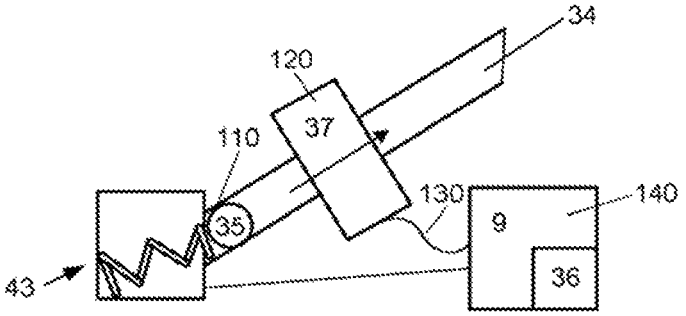
FIG. 4 a schematic and exemplary illustration of Detail IV of the coin processing device according to the invention, according to FIG. 2 in an alternative embodiment and example of a flow of the associated process for classifying coins

In another alternative embodiment illustrated in FIG. 4, the coin channel 34 can, for example be aligned incrementally toward the coin-disbursement basin 28. To convey the coin 35 an accelerating device 43 can be re-coupled with the coin channel 34. The necessary accelerating device 43 for conveying the coin is, for example mechanically designed, comprising a spring mechanism. By means of the spring mechanism, the coin 35 is conveyed by the coin channel 34 and the associated sensor 37 into the coin-disbursement basin 28.

Furthermore, FIG. 4 illustrates a sequence of the process for classifying coins with the coin processing device 10. In this case, the accelerating device 43 is activated in a first process stage step 110 from the computer control 9 by means of a signal, since a coin 35 will be disbursed. The accelerating device 43 comprises, for example a spring mechanism by means of an external power-operated actuator, with which the first process stage 110 accelerates the coin 35 and then moves it into the coin channel 34 passing the sensor 37. From the sensor 37 a second process stage 120 detects a processing time of the coin 35 by the range of the sensor 37. The detected processing time is then sent in a third process stage 130 to the sensor 37 coupled with the computer control 9.

The computer control 9 comprises a storage unit 36 in which a target velocity value is stored for the coin 35 or a respective coin class. The target velocity value for the coin 35 can be determined, for example by experiments in a learning mode of the computer control 9 or calculated mathematically. In addition, permissible tolerances may be stored in the storage unit 36 at any target velocity value.

In a fourth process stage 140, the processing time detected by sensor 37 by the computer control 9 calculates an actual velocity value for the coin 35. For the calculation, for example information about the acceleration of the coin 35 by means of the accelerating device 43, information about dimensions of the coin 35, and/or information on energy spent on the acceleration of the coin 35 can be used. The calculated actual velocity value of the coin 35 is then compared by the computer control 9 with the target velocity value for the coin 35 from the storage unit 36. Therefrom a coin class is determined for the coin 35 and it can be detected in a simple manner, whether, for example an error or manipulation in the disbursement of coins 35 is present.

Furthermore, in the fourth processing stage 140, while comparing the target velocity value and the actual velocity value of the coin 35, it can be tested if the stored tolerance for the respective nominal velocity value is achieved or exceeded. In case this tolerance is exceeded, for example an optically and/or acoustically perceptible alarm can be activated by the computer control 9. Of course, the coin processing device 10 with the computer control unit 9 form one unit. Furthermore, it is possible to have multiple coin-disbursement units 33 at the side of disbursement 38, each having an associated coin channel 34, a sensor 37 and optionally an accelerating device 43. An arrangement of the sensor 37 in the coin channel 34 at the side of insertion 38 is possible. This, for example can be classified in vending machines or in inserted coins 35 of game apparatuses for entertainment, using the process for classifying and testing coins 35 in a simple manner.

| REFERENCE NUMBERS | |
|---|---|
| 1. | Console |
| 2. | Header |
| 3. | Frame Part |
| 4. | Side Wall |
| 5. | Frame |
| 6. | Foot |
| 7. | Covering Plate |
| 8. | Rear Wall |
| 9. | Computer Control |
| 10. | Coin Processing Device |
| 11. | Coin Box |
| 12. | Coin-Insertion Slot |
| 13. | Return Key |
| 16. | Upper Front Flap |
| 17. | Lower Front Flap |
| 19. | Screen |
| 21. | Desk |
| 26. | Control Element |
| 28. | Coin-Disbursement Basin |
| 29. | Slot |
| 30. | Bill-Inserting/Bill-Disbursement Basin |
| 31. | Bill Processing Unit |
| 32. | Coin Controller |
| 33. | Coin-Disbursement Unit |
| 34. | Coin Channel |
| 35. | Coin |
| 36. | Storage Unit |
| 37. | Sensor |
| 38. | Side of Disbursement |
| 39. | Side of Insertion |
| 40. | Photoelectric Barrier |
| 41. | Transmitter |
| 42. | Receiver |
| 43. | Accelerating device |
| 44. | Arrow |
| 45. | Light Source |
| 46. | Light Receiver |
| 47. | Arrow |
| 48. | Arrow |
| 49. | Arrow |
| 50. | Compressed Air Nozzle |
| 110. | First Processing Stage |
| 120. | Second Processing Stage |
| 130. | Third Processing Stage |
| 140. | Fourth Processing Stage |

The invention claimed is:

1. A coin processing device with a computer control (9), wherein the computer control (9) comprises a storage unit (36), the coin processing device having at least one coin channel (34) for conveying a coin (35), wherein the at least one coin channel (34) has at least one sensor (37) suitable for measuring a throughput time of the coin (35), wherein the sensor (37) is an optical measurement device, the optical measurement device having at least one photoelectric barrier (40) having a light source (45) and two light receivers (46) in a throughput direction of the coin (35), the light receivers (46) being arranged on both sides of the light source (45) for receiving light radiation reflected on a peripheral edge of the coin (35), and wherein the sensor (37) is coupled with the computer control (9), and the coin processing device further having an accelerating device (43), which is coupled with the computer control (9) and is designed for a reproducible acceleration of the coin (35), and wherein a target velocity value for a particular coin (35) is stored in the storage unit (36), the target velocity value being comparable with an actual velocity value calculated on the basis of the throughput time detected by the sensor (37) such that therefrom the class of the coin (35) can be determined.

2. The coin processing device according to claim 1, characterized in that the accelerating device (43) for the coin (35) is designed mechanically, pneumatically or electromagnetically.

3. The coin processing device according to claim 1, characterized in that the computer control (9) activates an optically and/or acoustically perceptible alarm mechanism when the actual velocity value impermissibly deviates from the target velocity value.

4. The coin processing device according to claim 1, characterized in that the coin channel (34) has, at least in the area of the sensor (37), a friction-minimizing surface or surface coating.

5. A game apparatus for entertainment with a coin processing device (10) of claim 1.

6. A process for classifying coins in a coin processing device (10), wherein the coin processing device (10) comprises a computer control (9) with a storage unit (36), an accelerating device (43) designed for a reproducible acceleration of a coin (35) and at least one sensor (37) mounted in a coin channel (34) for detecting a throughput time of the coin (35), wherein the coin (35) with the aid of the accelerating device (43) in the coin channel (34) is conveyed (110) past the sensor (37) and in doing so the throughput time of the coin (35) is detected (120) by the sensor (37) and sent (130) to the computer control (9), wherein an actual velocity value for the coin (35) is calculated on the basis of the throughput time by the computer control (9), wherein then by the computer control (9) the actual velocity value of the coin (35) is compared with a target velocity value for the coin and therefrom a coin class of the coin (35) is determined (140), wherein the target velocity value for a particular coin (35) is stored in the storage unit (36), characterized in that the sensor (37) is an optical measurement device having at least one photoelectric barrier (40), wherein the photoelectric barrier (40) comprises a light source (45) and two light receivers (46) in a throughput direction of the coin (35), the light receivers (46) being arranged on both sides of the light source (45), and that the throughput time of the coin (35) is detected by the sensor (37) as light radiation of the light source (45) reflected on a peripheral edge of the coin (35) is successively received by the two light receivers (46) and in case of reception of the reflected light radiation a measurement signal is sent to the computer control (9).

7. The process according to claim 6, characterized in that the target velocity value for the coin (35) is determined by experiments in a learning mode of the computer control (9) and then stored in the storage unit (36).

8. The process according to claim 6, characterized in that the target velocity value for the coin (35) is determined mathematically by the computer control (9) and then stored in the storage unit (36).

9. The process according to claim 6, characterized in that each target velocity value is assigned allowable tolerances which are stored in the storage unit (36) with the respective target velocity value.

10. The process according to claim 6, characterized in that a visually and/or acoustically perceptible alarm device is activated by the computer control (9) at exceeding a tolerance level in comparison of the actual velocity value with the respective target velocity value (140).

11. The process according to claim 6, characterized in that the accelerating device (43) is activated by the computer control (9) by means of an applied signal (110).

* * * * *